US010189696B2

(12) United States Patent
Morgan et al.

(10) Patent No.: US 10,189,696 B2
(45) Date of Patent: Jan. 29, 2019

(54) BOTTLED BAG FLUID DISPENSER

(71) Applicant: Utrem Innovation, LLC, Houston, TX (US)

(72) Inventors: Travis Morgan, Houston, TX (US); Christian Cortez, Houston, TX (US)

(73) Assignee: Utrem Innovation, LLC, Houston, TX (US)

( * ) Notice: Subject to any disclaimer, the term of this patent is extended or adjusted under 35 U.S.C. 154(b) by 0 days.

(21) Appl. No.: 15/603,700

(22) Filed: May 24, 2017

(65) Prior Publication Data

US 2017/0341922 A1 Nov. 30, 2017

Related U.S. Application Data

(60) Provisional application No. 62/340,785, filed on May 24, 2016.

(51) Int. Cl.

| | |
|---|---|
| ***B65D 41/34*** | (2006.01) |
| ***B67D 3/00*** | (2006.01) |
| ***B65D 77/06*** | (2006.01) |
| ***B65D 47/28*** | (2006.01) |
| ***B65D 47/32*** | (2006.01) |
| ***B65D 51/18*** | (2006.01) |

(52) U.S. Cl.

CPC ..... *B67D 3/0067* (2013.01); *B65D 47/286* (2013.01); *B65D 47/32* (2013.01); *B65D 51/18* (2013.01); *B65D 77/06* (2013.01); *B67D 3/0051* (2013.01); *B65D 41/34* (2013.01); *B65D 2251/0015* (2013.01); *B65D 2251/0087* (2013.01)

(58) Field of Classification Search

CPC ..... B65D 3/0051; B65D 3/0067; B65D 47/20
USPC ..... 222/92, 94, 105, 107, 153.01–153.14, 222/481.5, 547, 562, 563, 569, 570; 220/202, 203.01, 203.06, 203.07, 203.19
See application file for complete search history.

(56) References Cited

U.S. PATENT DOCUMENTS

| | | | | | |
|---|---|---|---|---|---|
| 1,452,039 | A * | 4/1923 | Gravell | B29C 63/343 | 119/203 |
| 2,598,403 | A * | 5/1952 | Macey | B65D 47/283 | 215/309 |
| 4,809,884 | A * | 3/1989 | Stackhouse | B67D 1/045 | 222/153.04 |
| 5,072,861 | A * | 12/1991 | Jou | B67D 3/00 | 222/481 |
| 7,140,519 | B1 * | 11/2006 | Kiser | B65D 49/04 | 222/500 |
| 7,395,949 | B2 * | 7/2008 | Ehret | B67D 1/045 | 215/231 |
| 8,561,853 | B2 * | 10/2013 | De Mei | B65D 81/245 | 222/153.04 |

(Continued)

*Primary Examiner* — Vishal Pancholi
(74) *Attorney, Agent, or Firm* — D'Ambrosio & Menon, PLLC; Usha Menon

(57) ABSTRACT

An apparatus for dispensing a beverage comprising: a bottle; a bladder for containing the beverage; and a spigot for dispensing the beverage, wherein the bladder is sealed to the base portion of the spigot. The spigot comprises: one or more air ports; and one or more vertical ridged elements. The beverage is entirely contained within the bladder. This bag-in-bottle beverage dispenser may be used as a container and dispenser of wine and other air and photosensitive consumables.

12 Claims, 7 Drawing Sheets

(56) References Cited

U.S. PATENT DOCUMENTS

| | | | | |
|---|---|---|---|---|
| 8,807,358 | B2 * | 8/2014 | Devoy | B01F 3/0446 215/309 |
| 2009/0108022 | A1 * | 4/2009 | Huggins | B67D 3/0041 222/153.04 |
| 2010/0091605 | A1 * | 4/2010 | Rasmussen | B01F 3/0446 366/107 |

* cited by examiner

BOTTLED BAG FLUID DISPENSER

CROSS-REFERENCE TO RELATED APPLICATION

This application claims the benefit of priority of U.S. Provisional Application Ser. No. 62/340,785, filed May 24, 2016, by Travis Morgan and Christian Cortez entitled "Bottled Bag Fluid Dispenser". The disclosure of this application is considered part of (and is incorporated by reference in) the disclosure of this application in its entirety.

FIELD OF THE INVENTION

This disclosure relates generally to beverage dispensers.

BACKGROUND

Wine is typically sold in glass bottles. The wine bottles usually have cork or synthetic seals. Boxed wine is increasingly popular. Boxed wines, which includes for the purposes of this disclosure, bag-in-box wines, bag-in-bag wines or simply bagged wines, are typically less expensive, shatterproof, lighter and easier to transport and store as compared to bottled wine. Boxed wine is also not subject to cork taint, common to bottled wine, since the wine is dispensed from a plastic spout.

SUMMARY

According to an embodiment, an apparatus for dispensing a beverage includes: a bottle; a bladder for containing the beverage; and a spigot for dispensing the beverage. The bladder is sealed to the base portion of the spigot. The spigot comprises: one or more air ports; and two or more vertical ridged elements. The beverage may be an alcoholic or non-alcoholic beverage. In an embodiment, the beverage includes wine. The beverage shall be entirely contained within the bladder. According to an embodiment, the bottle comprises a glass bottle and the bladder comprises a plastic bag. The plastic bag is sealed to the spigot.

The spigot may have a cylindrical geometry. The spigot further comprises a top portion and a base portion. The top portion of the spigot has a larger diameter than the base portion. The one or more air ports are located on the top portion of the spigot. In an embodiment, each air port comprises a cutout on a wall of the top portion of the spigot. The one or more air ports are configured to facilitate air flow inside the bottle. The one or more vertical ridged elements are located on the lower portion of the spigot. The one or more ridged elements are configured to create an air gap between the spigot and the bottle. The spigot further includes an opening for passage of the beverage. The opening traverses the length of the spigot. The spigot further comprises an actuator. In one embodiment, the actuator comprises a push button for actuating flow of the beverage through the opening.

Although the drawings represent varied embodiments and features of the present disclosure, the drawings are not necessarily to scale and certain features may be exaggerated in order to illustrate and explain exemplary embodiments the present invention. The exemplification set forth herein illustrates several aspects of the invention, in one form, and such exemplification is not to be construed as limiting the scope of the invention in any manner.

DETAILED DESCRIPTION

The following description of the embodiments of the invention has been presented for the purpose of illustration; it is not intended to be exhaustive or to limit the invention to the precise forms disclosed. Persons skilled in the relevant art can appreciate that many modifications and variations are possible in light of the disclosure below.

Boxed wine is wine that is packaged in a non-glass container. Typically, the wine is contained within a bag/bladder. The bag may be further contained within fiberboard box. Boxed wines are associated with cheaper and lower quality wines. Accordingly, boxed wine is not preferred by discerning wine connoisseurs. These consumers also prefer the aesthetics of wine in a glass bottle.

Unopened boxed wine is associated with a shorter shelf life than an unopened bottle of wine. However, bottled wine has to be consumed within hours or within a few days after the bottle is opened. When bottled wine is opened, a chemical reaction called oxidation occurs which causes the wine to spoil. Oxidation can be slowed down by resealing the bottle and removing the oxygen. Devices like wine savers and other after-market accessories can extend the life of the remaining wine in an opened bottle for only a few days. Thus, if an average consumer purchases a relatively expensive bottle of wine, he would have to finish it quickly before it oxidizes. Boxed wine is not typically subject to oxidation since the wine is not exposed to air.

There is a need for an invention that extends the shelf life of a fluid after the bottle has been opened, without the use of a third party mechanism. The invention should ensure that the wine does not oxidize for a relatively long period, for example, a month or more after the bottle is first opened or after the first pour. The invention should include a mechanism to securely seal the bottle. The seal should preferably be air-tight such that a consumer can drink a desired amount, for instance, one glass of wine and be assured that the leftover wine in the bottle will not spoil quickly.

Figure 1:
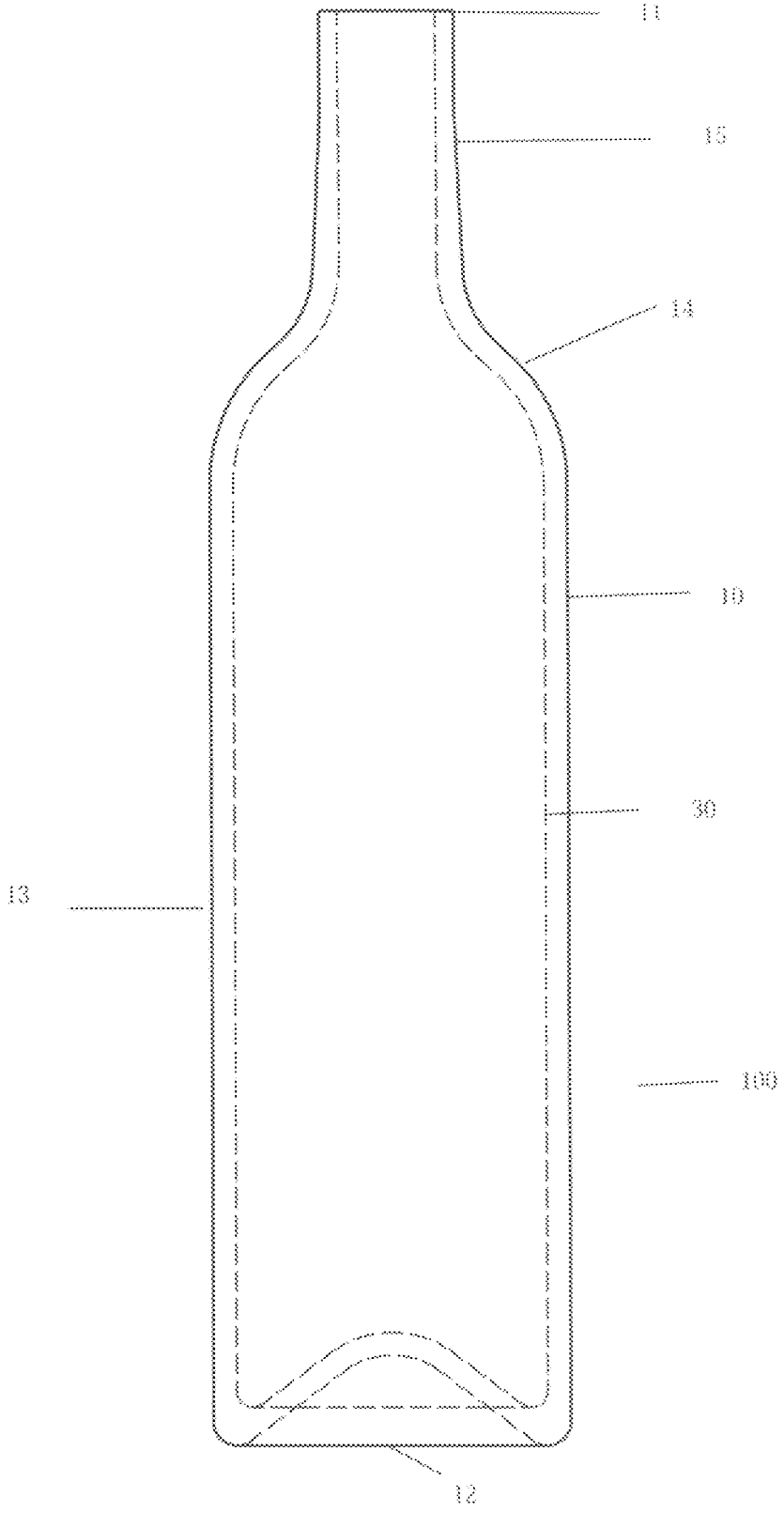
FIG. 1 illustrates a bottled bag fluid dispenser in accordance with an embodiment.

FIG. 1 illustrates an apparatus for dispensing fluids. In certain embodiments, the apparatus can combine the aesthetics of a wine bottle with the delayed oxidation features of a boxed wine. According to an embodiment, the apparatus comprises a bottled bag fluid dispenser 100. The bottled bag fluid dispenser 100 may be used as a container and dispenser of any fluid (not shown). Although the exemplary embodiments are described with reference to a wine dispenser, a person skilled in the art will recognize that the bottled bag fluid dispenser 100 may be used to dispense other fluids, such as, cooking oil, olive oil and other fluids including, but not limited to, medicinal fluids that are sensitive to air and light. Spouts known in the industry may be used to fill the bottles with the desired fluid.

The bottled bag fluid dispenser 100 can replace traditional wine bottles by allowing a consumer to pour a glass of wine without exposing the remaining wine in the bottle to oxygen, and thus leaving it subject to oxidation. The bottled bag fluid dispenser 100 can prevent oxidation of the remaining wine and preserves any remaining wine for up to a month after opening. Thus, the bottled bag fluid dispenser 100 obviates the need for buying expensive aftermarket parts or sealing devices to prevent unused wine from being spoiled.

The bottled bag fluid dispenser 100 comprises a bottle 10 and a bladder 30. The bottle 10 may be made of glass, polycarbonate or another suitable material. The bottle 10 may be made of a dark color, such as, dark green or black in color to protect the wine from light and to conceal the bladder 30 for aesthetic purposes.

The most popular wine bottle size and shape today that is used for most wines is the standard Bordeaux shaped bottle. The standard bottle mirrors the common 750 ml Bordeaux bottle. The bottle 10 can have the same shape as a standard or traditional wine bottle. However, the bottle 10 is between 50-100 ml larger in order to compensate for the bladder 30.

As with standard bottles, bottle 10 includes a mouth 11, a base 12, a body 13, a shoulder 14 and a neck 15. In one embodiment, however, the neck 15 is around half the height of the neck of a standard wine bottle. For example, in one embodiment, the neck 15 is 1.5 inches tall. This is in contrast to the neck of a standard bottle that is about 2.8 inches tall.

Figure 2:
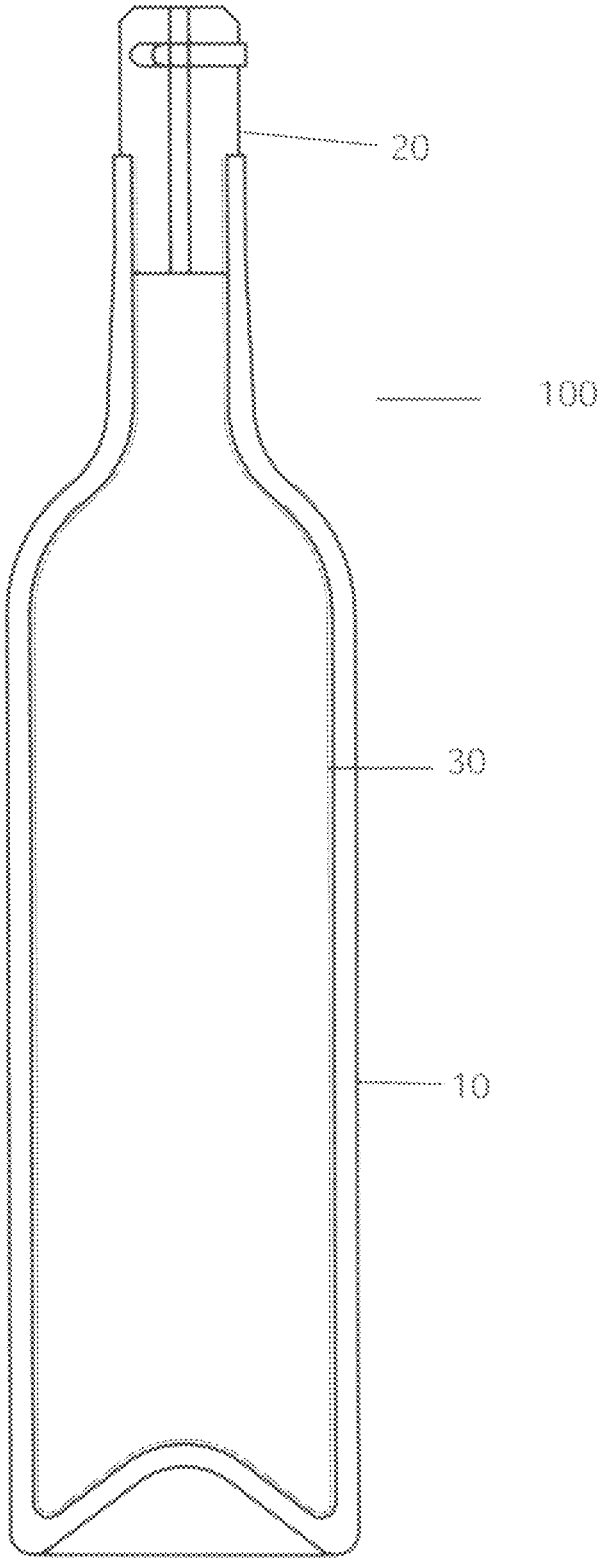
FIG. 2 illustrates a bottled bag fluid dispenser with a spigot in accordance with an embodiment.
Figure 3:
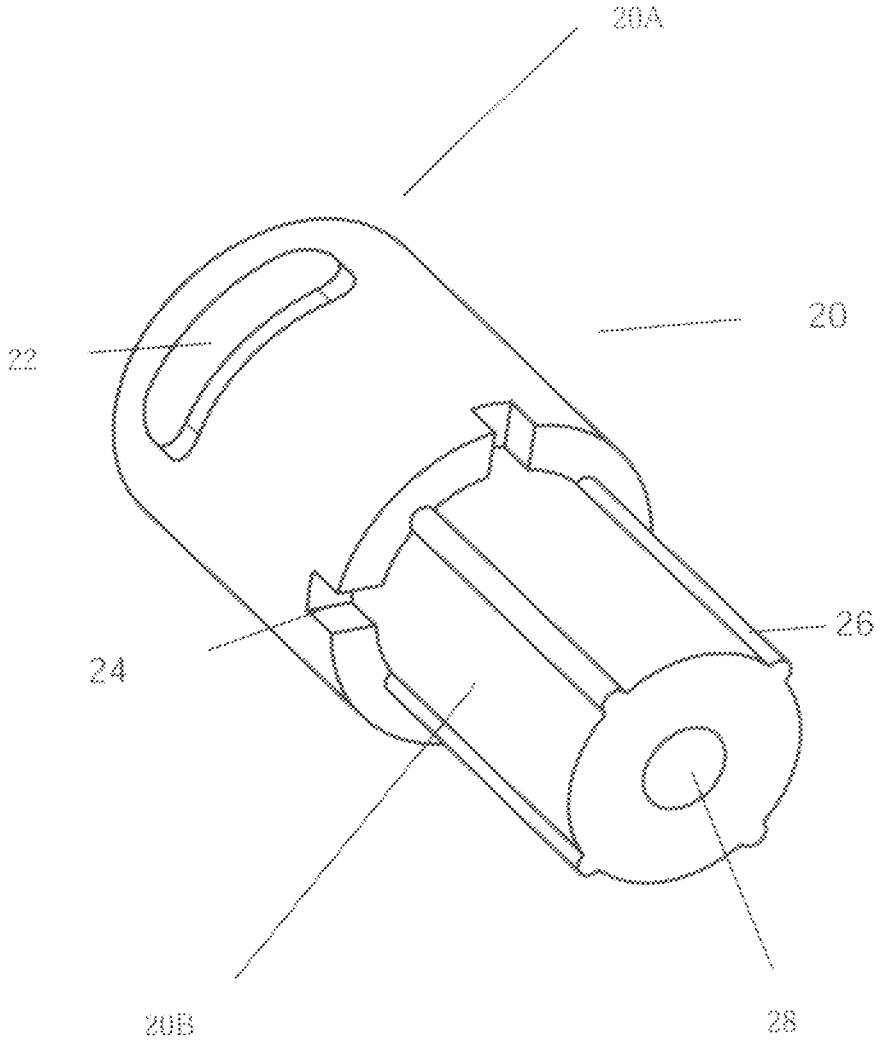
FIGS. 3-6 illustrate various view of the spigot in accordance with an embodiment.
Figure 4:
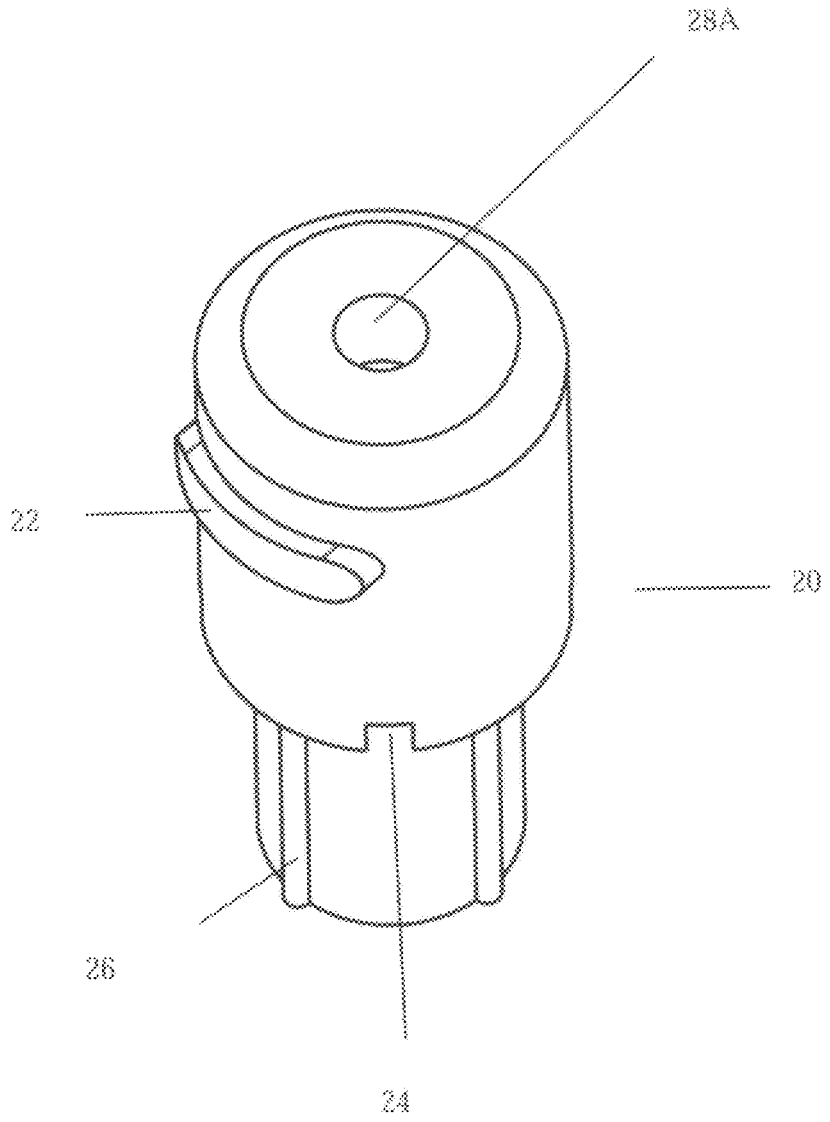
Figure 5:
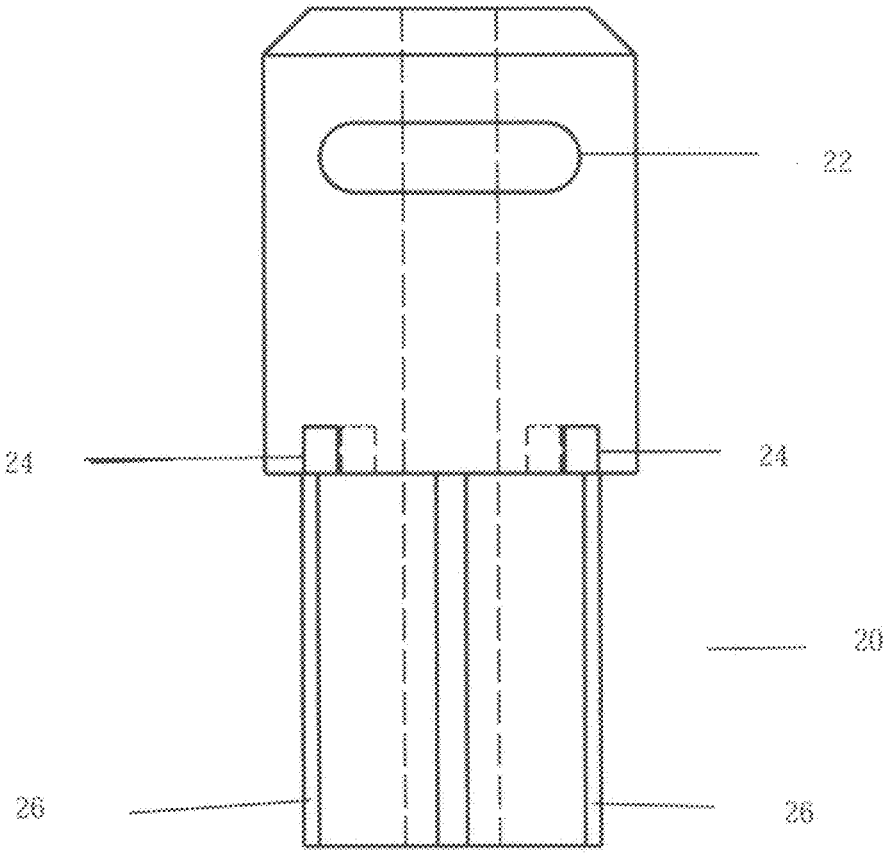
Figure 6:
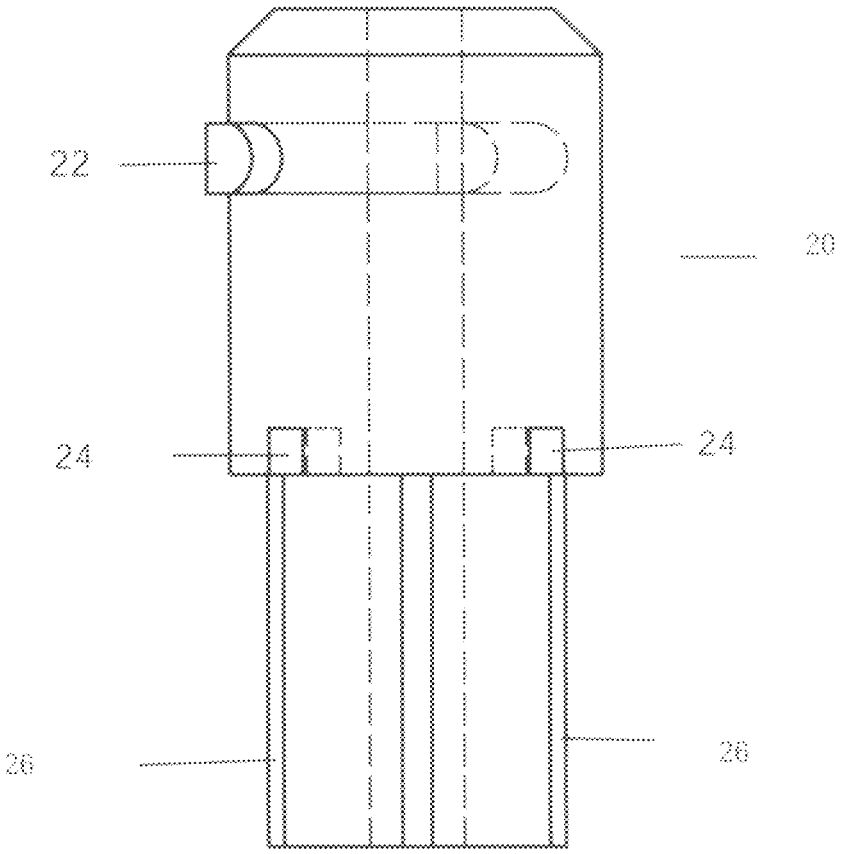

Now referring to FIGS. 1 and 2, the bottle 10 further includes an internal bladder 30. The bladder 30 can comprise a bag. For example, the bag is a plastic bag. The bag 30 may be configured to hold wine. For instance, the bag 30 may be configured to hold about 750 ml of wine thus adhering to the standard capacity of alcohol bottles. While this is the same capacity as a standard wine bottle, it is lower than the capacity of a boxed wine container which can hold around 3,000-4,000 ml of wine. The wine is completely contained within the bag 30 as opposed to within the bottle for standard wine bottles. This ensures that any remaining wine is not immediately subjected to oxidation after the bottle 10 is opened.

The bag 30 may be made from a suitable material, such as, plastic, polyurethane, etc. The bag 30 may be a food or medicinal grade bag.

Figure 7:
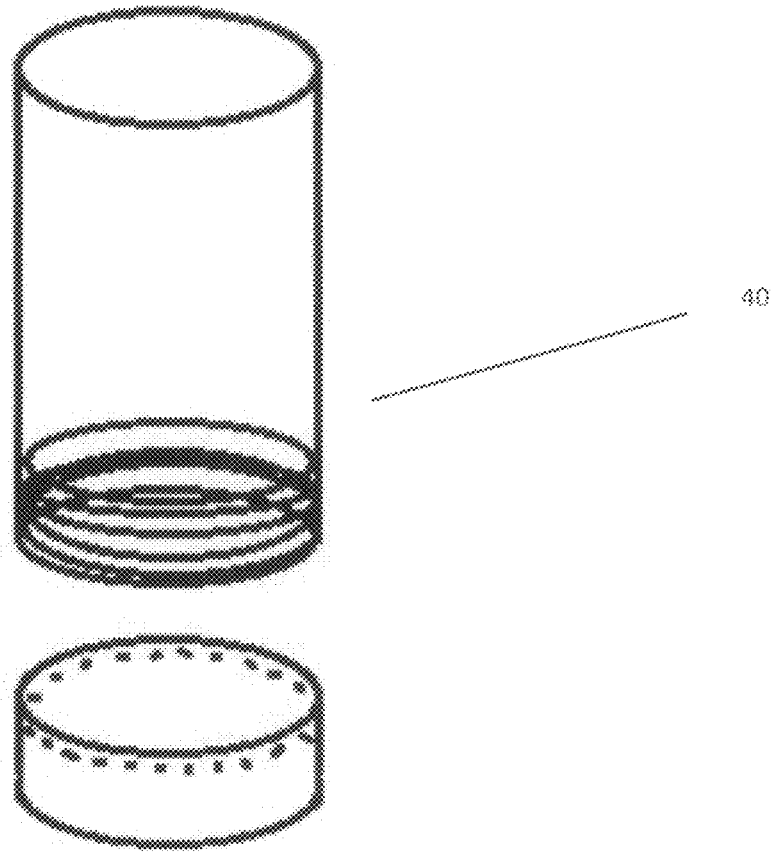
FIG. 7 illustrates a closure for the bottled bag fluid dispenser in accordance with an embodiment.

Standard wine bottles are traditionally sealed with a cork. However, screw-top caps, plastic/glass caps, etc. are becoming increasing popular. In one embodiment, bottle 10 includes a closure 40, as shown in FIG. 7, for providing a secondary seal, concealing the spigot 20 and acting as tamper evidence. The closure 40 may be threaded and may include a tamper proof seal. The tamper proof seal may be perforated. The neck 15 may be threaded to receive the closure 40. The closure 40 may comprise a cap. The cap 40 may be configured to be a twist-off cap. The cap 40 can be about twice the height of a current wine bottle cap, such that the combination of the shorter neck 15 and the taller cap 40 causes the bottle 10 to appear to have the same height as a traditional wine bottle when both are unopened. For example, the cap 40 may 1.3-1.6 inches in height while the height of a standard cap would be approximately 0.8-1 inches. This ensures that shipping and storage practices are not disrupted and these practices can be the same as shipping and storing traditional wine bottles. Additionally, it can ensure that the bottle 10 does not stand out from the traditional bottles in a negative way.

In one or more embodiments, the cap 40 is further configured to conceal a spigot 20. Wine can be poured out from an opening or a nozzle on or a tap in the spigot 20. The concealed spigot 20 allows the bottled bag fluid dispenser 100 to blend in with standard wine bottles. It can also function as a tamper evidence feature, preserving the conversation of product inside. Alternately, in another embodiment (as shown in FIG. 2), the bottle is devoid of a cap 40. In this embodiment, the spigot 20 is unconcealed.

The bag 30 is affixed to the base portion 20B of the spigot and inserted into the bottle 10. It may be sealed such that wine can only flow out of the spigot 20. The bag 30 may be sealed using ultrasonic welding. This ensures that fluid will not leak out of the bag or be exposed to air.

An embodiment of the spigot 20 is depicted in FIGS. 3-6. The spigot 20 may be cylindrical in shape. However, the spigot 20 can also have any geometry to match the mouth and the neck of the bottle. The spigot 20 comprises plastic or another suitable material. Advantageously, the spigot 20 is not made of cork thereby ensuring that the wine in bottle 10 is not subjected to the cork taint associated with standard wine bottles.

The spigot 20 can include an integral top portion 20A and a base portion 20B. The top portion 20A may have a larger diameter than the base portion 20B such that when the spigot 20 is inserted within the bottle 10, the top portion 20A is positioned above the mouth of the bottle 10 while the base portion 20B abuts the neck 15 of the bottle. The top portion 20A of the spigot may be sealed within the closure 40.

The top portion of the spigot 20A can include an actuator 22. The actuator 22 may include a push button or another suitable mechanism for actuating an opening 28 that traverses the length of the spigot 20. In one or more embodiments, the push button 22 is configured to traverse the width of the opening such that it prevents wine from unintentionally leaking out of the bag 30, when the bottle 10 is tilted. Alternately, the push button 22 may be configured to be coupled with a plug or one or more linked elements that cause the opening 28 to be plugged or closed. When the push button 22 is depressed or pushed, it retracts from the opening 28 thereby creating an open channel for the wine to be poured out. Wine can be poured out from a top or first end of the opening 28A. Although the first end of the opening 28A is shown located on a top surface of the spigot 20, it is understood that the first end can be located on a sidewall of the top portion 20A of the spigot.

Current boxed wine designs cannot work in a standard bottle design. The spigot 20 of the present disclosure is configured to serve a unique function. The spigot 20 comprises a plurality of air ports 24. In one embodiment, each air port or port 24 may include a cutout or opening in the wall of the top portion 20A of the spigot. Thus, the ports 24 may be located above the mouth of the bottle. The ports 24 facilitate maintenance of atmospheric pressure inside the bottle 10. This can allow wine to flow smoothly through the opening 28. Boxed wine does not have this issue since the box is not air tight.

The ports 24 may be located on the top portion 20A of the spigot and below the button 22. In one embodiment, the base portion 20B of the spigot may include four ports 24. The ports 24 facilitate the passage of airflow into the body 13 of the bottle. This creates atmospheric pressure that allows the bladder 30 to collapse, as the fluid is dispensed.

The base portion 20B of the spigot 20 comprises a plurality of vertical ridged elements 26. In one embodiment, the spigot 20 can include four vertical ridged elements 26. Each ridged element or ridge may be separated from an adjacent ridge by a predetermined distance. The ridges 26 may run parallel to each other. These ridges 26 are configured to create a slight gap between the neck of the bottle 15 and the spigot 20. This gap allows air to flow between the spigot 20 and the neck 15 of the bottle into the body of the bottle. When a user wants to consume wine, he can tilt the bottle 10 over a wine glass (not shown). The user then pushes the button 22 so that it opens up the pathway for the wine to flow from the first end of the opening 28A into the wine glass.

In certain embodiments, the bottle 10, spigot 20, bladder 30 and other components may potentially be manufactured from recycled materials thereby making the design environmentally friendly. Furthermore, the actual plastics that are used to make the bottled bag fluid dispenser 100 may be altered to make it even more eco-friendly and economical.

Embodiments of the invention may allow wine to last up to a month or longer after the bottle 10 is opened. If poured correctly, air will be restricted from entering inside the bladder 30 thereby slowing or delaying the oxidation of the remaining wine. The wine may also be vacuum sealed into the bladder 30 so that no air is trapped inside during the initial bottling process. Thus, the bottled bag fluid dispenser 100 allows users or consumers of high end wines to get the benefits of the boxed wine technology without the use of cardboard or other fiberboards.

The bottled bag fluid dispenser 100 can be configured such that it is not limited to any particular style and it is aesthetically pleasing to any wine connoisseur. As such, it can be placed next to any standard wine bottle without appearing out of place in a bottle collection. The bottled bag fluid dispenser 100 can also preserve unconsumed wine for a substantially longer duration than an opened bottle of wine. Aside from the associated aesthetic benefits and cost savings, the user can avoid binge drinking or over indulging due to concerns that any unconsumed wine would be spoilt. The embodiments of the invention could be used for any brand wine. Additionally, the embodiments of the invention can help expand capabilities of modern food storage practices and medicine.

In one or more embodiments, the bottle 10 can be manufactured in any desired shape. The neck 15 of the bottle and the spigot 30 can also be suitably altered. Furthermore, the spigot may include a spout, or a tap/nozzle (not shown) for more contoured/precision space.

In another embodiment, the bladder can be configured to be removable from the bottle so even the last drop can be squeezed from the bag. The bag can be configured such that it cannot come out when it is full, but could be pulled back out when it is almost empty. In one or more embodiments, a nozzle pulling device (not shown) may be used to remove the bag from the bottle.

In yet another embodiment, the bottle can be configured to come apart, so consumers could buy replacement bags of wine and use the bottle just to conceal it on the shelf. In this embodiment, the bottle is manufactured from fiberboard or a material other than glass for manufacturing and safety purposes.

The embodiments of the invention may be used by vineyards or bottling companies. The bottled bag fluid dispenser 100 can replace standard bottles that are currently in use, including, standard wine bottles.

The language used in the specification has been principally selected for readability and instructional purposes, and it may not have been selected to delineate or circumscribe the inventive subject matter. It is therefore intended that the scope of the invention be limited not by this detailed description. Accordingly, the disclosure of the embodiments of the invention is intended to be illustrative, but not limited to, the scope of the invention.

No limitation with regard to the described aspects or embodiments of the present invention is intended. Many modifications to the depicted embodiments may be made without departing from the spirit and scope of the present invention. For example, the spigot described herein may be used with other types of bottles, including standard wine bottles. Accordingly, the foregoing description is intended to be illustrative rather than restrictive.

While the bottled bag fluid dispenser and its components are described in terms of "comprising," "containing," or "including", the dispenser also can "consist essentially of" or "consist of" the various components. If there is any conflict in the usages of a word or term in this specification and one or more patent(s) or other documents that may be incorporated herein by reference, the definitions that are consistent with this specification should be adopted.

The invention claimed is:

1. An apparatus for dispensing a beverage comprising:
- a bottle;
- a bladder for containing the beverage; and
- a spigot for dispensing the beverage, wherein the spigot comprises:
  - one or more air ports, wherein each air port comprises a cutout on a wall of the spigot, wherein the one or more air ports are configured to maintain atmospheric pressure inside the bottle; and
  - one or more vertical ridged elements, wherein the bladder is sealed to a base portion of the spigot, and wherein the one or more ridged elements are configured to create an air gap between the spigot and the bottle to allow air to flow into a body of the bottle.

2. The apparatus according to claim 1, wherein the beverage is wine.

3. The apparatus according to claim 1, wherein the beverage is entirely contained within the bladder.

4. The apparatus according to claim 1, wherein the bottle comprises a glass bottle.

5. The apparatus according to claim 1, wherein the bladder comprises a plastic bag.

6. The apparatus according to claim 1, wherein the spigot has a cylindrical geometry.

7. The apparatus according to claim 1, wherein the spigot further comprises:
- a top portion, wherein the top portion of the spigot has a larger diameter than the base portion.

8. The apparatus according to claim 1, wherein the one or more vertical ridged elements are located on the lower portion of the spigot.

9. The apparatus according to claim 1, wherein the spigot further comprises an opening for passage of the beverage, and wherein the opening traverses the length of the spigot.

10. The apparatus according to claim 1, wherein the spigot further comprises an actuator for actuating the opening traversing the length of the spigot.

11. The apparatus according to claim 10, wherein the actuator comprises a push button for actuating flow of the beverage through the opening, wherein the push button is configured to traverse the width of the spigot.

12. A spigot for dispensing an alcoholic beverage, wherein the spigot comprises:
- a top portion, wherein the top portion comprises one or more air ports, wherein each air port comprises a cutout on a wall of the spigot, wherein the one or more air ports are configured to maintain atmospheric pressure inside the bottle;
- a base portion, wherein the base portion comprises one or more vertical ridged elements, wherein the bladder is sealed to a base portion of the spigot, and wherein the one or more ridged elements are configured to create an air gap between the spigot and the bottle to allow air to flow into a body of the bottle;

an opening for passage of the beverage, wherein the opening traverses the length of the spigot; and an actuator for actuating flow the beverage through the opening, wherein the actuator is located on the top portion.

* * * * *